US005323707A

United States Patent [19]

Norton et al.

[11] Patent Number: 5,323,707

[45] Date of Patent: Jun. 28, 1994

[54] CONSUMABLE LOW ENERGY LAYERED PROPELLANT CASING

[75] Inventors: Richard V. Norton, Wilmington, Del.; William J. Worrell, Jr., Draper, Va.

[73] Assignee: Hercules Incorporated, Wilmington, Del.

[21] Appl. No.: 886,563

[22] Filed: May 18, 1992

Related U.S. Application Data

[63] Continuation-in-part of Ser. No. 740,535, Aug. 5, 1991, abandoned.

[51] Int. Cl.[5] ..... F42B 5/18

[52] U.S. Cl. ..... 102/431; 102/466; 102/700

[58] Field of Search ..... 102/282, 331, 431–433, 102/466, 469, 700

[56] References Cited

U.S. PATENT DOCUMENTS

| | | | |
|---|---|---|---|
| 3,098,444 | 7/1963 | Walkey et al. | 102/431 |
| 3,397,637 | 8/1968 | Bobinski et al. | 102/431 |
| 3,598,052 | 10/1971 | Schwartz et al. | 102/466 |
| 3,696,748 | 10/1972 | Picard et al. | 102/431 |
| 3,771,460 | 11/1973 | Ayer | 102/282 |
| 3,927,616 | 12/1975 | Axelrod et al. | 102/431 |
| 4,709,636 | 12/1987 | Mueller et al. | 102/431 |

FOREIGN PATENT DOCUMENTS

| | | | |
|---|---|---|---|
| 2557284 | 6/1985 | France | 102/331 |

*Primary Examiner*—Harold J. Tudor
*Attorney, Agent, or Firm*—Mark Goldberg

[57] ABSTRACT

A multi-layered cylindrical propellant casing comprising an inner propellant-holding layer of polymer layer(s) obtained by lay up, blow molding, or similar fabrication of an energetic or nonenergetic type layer, coated with (an) intermediate adhesive layer(s) of an energetic or non-energetic type, and covered by an outer, concentrically arranged, coat or layer having a higher resistance, than said inner layer, to circumferential expansion; plus a corresponding method for increasing the amount of fragmentation and combustion rate of such propellant casing when exposed to a firing sequence.

18 Claims, 4 Drawing Sheets

CONSUMABLE LOW ENERGY LAYERED PROPELLANT CASING

The present invention is a continuation-in-part of U.S. Ser. No. 07/740535 filed on Aug. 5, 1991 now abandoned, that relates to combustible, but flash-resistant, inert layered propellant casings and a method for increasing the fragmentation and combustion rate of such casings during a conventional firing sequence.

BACKGROUND

Environmental stability, high impact strength, resistance to flame and shock, and low cost are among the most important and desired characteristics for containers such as gun propellant casings.

To achieve strength and to resist flame and shock, however, it is generally necessary to limit or wholly replace casing materials of a high energetic nature, such as felted nitrocellulose casings with low energy polymeric material and to attempt to make up the difference by achieving a higher propellant-packing density.

The use of inert, tough organic compounds such as synthetic resins (U.S. Pat. No. 3,749,023), polycarbonates, polysulfones and blends thereof with polyethylene (U.S. Pat. No. 3,745,924), Polyethylene terphthalate (PET) (U.S. Pat. No. 3,901,153), polyester film (U.S. Pat. No. 4,282,813), or similar polymeric materials, however, are not fully satisfactory as substitutes for nitrocellulose (NC) felting, because of difficulty in carrying out firings without fouling a barrel and gun breach with partly consumed casing. Such smoking residue also presents a serious air pollution and storage problem within the confines of a tank or similar vehicle under buttoned down combat conditions.

Attempts at compromise, such as the use of thin sheets of plastic interspaced between traditional felted nitrocellulose layers (U.S. Pat. No. 3,901,153) have resulted in some improvement in moisture resistance and handling properties, but have not succeeded in adequately addressing case combustion problems.

The present invention substantially increases consumability by increasing the amount of fragmentation and the resulting combustion of a propellant-charged gun propellant casing used in a conventional firing sequence. In addition the practice of this invention obtains a consumable inert propellant casing having improved flame and shock resistance plus increased mechanical durability.

SUMMARY OF THE INVENTION

The present invention relates to a method for increasing fragmentation and combustion rate of a propellant charged polymer-containing gun propellant casing used in a firing sequence, comprising manufacturing a casing wall comprising at least a propellant-holding inner element, at least one intermediate adhesive layer, and an outer expansion-resistant cylindrical-shaped casing layer externally concentrically arranged with respect to said inner element, said outer layer and said inner element being (a) characterized, in combination, as film(s), film laminates, and/or fiber winding(s) having a significantly high hoop strength (circumferential modulus) relative to corresponding longitudinal casing wall strength; and (b) characterized individually as having circumferential moduli of said outer layer-to-said-inner element within a ratio of about (10–50)-to-(1–8); wherein propellant ignited within said inner element generates an effective amount of pressure, initially effecting expansion of said inner element and adhesive layer against said outer expansion-resistant layer, creating a plurality of randomly positioned microflaws having rapid propagation velocity within said casing, thereby obtaining a high degree of microfragmentation and combustion of casing components.

The present invention further relates to a consumable gun propellant casing comprising, in combination, (i) an open ended inner element of at least one expand able polymeric layer holding propellant material;

(ii) an open ended expansion-resistant cylindrical shaped outer layer externally concentrically arranged with respect to said inner element, said outer layer having a circumferential modulus effectively high than the corresponding circumferential modulus of said inner element;

(iii) at least one adhesive layer positioned between said inner element and said expansion resistant outer layer; and (iv) consumable end cap(s) secured to the open ends of said propellant casing, at least one of said end caps having a firing initiator port functionally associated with an igniter assembly means for effecting the firing of propellant material held within said casing;

whereby propellant ignited by said igniter assembly means through said igniter port initially generates an effective amount of pressure with expansion of said inner element and adhesive layer against the inside wall of said expansion-resistant outer layer, creating a plurality of randomly positioned microflaws having rapid propagation velocities within the casing wall before failure of said expansion-resistant outer layer, to effect microfragmentation and consumption of the fragmented casing.

DETAILED DESCRIPTION OF THE INVENTION

The present invention comprises a consumable gun propellant casing having at least a three (3) layer casing wall comprising at least a propellant-holding inner element, an intermediate adhesive layer, and an outer expansion-resistant cylindrical shaped casing layer externally concentrically arranged with respect to the inner element, wherein the outer layer and inner element are (a) characterized, in combination, as film(s), film laminate(s), and/or fiber winding(s) having a significantly high hoop strength (circumferential modulus) relative to the corresponding longitudinal casing wall strength (i.e. axial direction); and (b) characterized individually as having circumferential moduli (i.e. expansion resistance) of the outer layer-to-the inner element within a ratio of about 10–50 to 1–8, or even higher;

wherein propellant ignited within the inner element is capable of generating an effective amount of pressure by initially effecting expansion of the inner element and adhesive layer against the outer expansion-resistant layer, creating a plurality of randomly positioned microflaws having rapid propagation velocities within the casing, and thereby obtaining a high degree of microfragmentation and combustion of casing components.

The corresponding gun propellant casing more specifically comprises, in combination, (i) an open-ended inner element of at least one expandable polymeric layer holding propellant material;

(ii) an open ended expansion-resistant cylindrical shaped outer layer externally concentrically arranged with respect to the inner element, the outer layer preferably having a circumferential modulus or hoop strength effectively higher than the corresponding circumferential modulus of the inner element within the above-defined modulus parameters; and (iii) at least one adhesive layer, preferably a brittle adhesive defined as having little or no plastic flow, positioned between the inner element and the expansionresistant outer layer.

When required, consumable end caps are secured to the open ends of the propellant casing, at least one end cap having a firing initiator port functionally associated with an igniter assembly means, for effecting the ignition of the propellant material held by the casing. For present purposes, such igniter assembly means can be of a conventional type such as a spark, laser, or fulminate-type detonator with igniter tubes and the like, as needed.

For purposes of the present invention, the phrase "significantly high hoop strength (circumferential modulus) relative to corresponding longitudinal strength of said casing wall" is here defined quantitatively as falling within a range (based on relative modulus) of about (100–1000) to 1, or higher, which is high enough to assure avoidance of the natural tendency of conventional propellant casings to split down the center in an axial direction (i.e. elastic failure) under high internal pressure. Such splitting usually results in very poor casing combustion.

Functionally speaking, propellant ignited by an igniter assembly means through an igniter port generates an "effective amount" of pressure, which is here defined as the amount needed to initially cause expansion of the inner element and adhesive layer(s) against the inside wall of the expansion-resistant outer layer, thereby creating microflaws having rapid propagation velocities within the casing wall before failure. Ultimate failure of the expansion-resistant outer layer of the casing normally occurs very suddenly, creating violent shock waves which, in turn, aid in achieving desired extensive microfragmentation and ultimate consumption of the multi-fragmented casing.

By way of example, and depending upon the desired caliber, the casing wall, particularly the outer expansion-resistant layer should be capable of withstanding an internal firing pressure within a range of about 1000 psi to 4000 psi or higher, and possess the above-indicated emphasis in tensile strength along the circumferential or hoop direction; the inner element should be capable of at least some elastic expansion within the above pressure range and preferably be capable of withstanding at least some of the internal pressure load designed into the outer layer. It is most important, in this connection, that the modulus ratio of outer layer-to-inner element be generally kept within the above-indicated ratios. For present purposes, the higher the modulus or tensile strength of the inner casing element relative to the modulus of the outer layer, the greater the number of microflaws randomly formed and propagated. In this regard it is sometimes found useful to include a heat aging step to make an inner element, such as a laid up or molded polyethylene terephthalate, or a polyether imide (such as Ultem 1000 or other similar General Electric product) into a more brittle crystalline material.

It is also possible to fine tune the above-indicated circumferential modulus ratio by externally wrapping the inner and/or outer film laminate or molded layers on a mandrel with a fiber wrapping. Such wrapping may usefully vary from about 1–3 mil or higher, depending on casing size.

In any case, the higher the modulus, the more violent is the failure of the casing wall due to internal pressure build-up, the more microflaws exist, and the more efficient is the ultimate casing break up into fine, consumable particulate matter. Suitable differences in modulus between the inner layer and the outer layer, and satisfactory casing consumption can best be achieved in accordance with the instant invention.

In practicing the present invention, it is additionally advantageous to keep in mind that it is advisable, when using film laminates (1) to avoid, or at least minimize, the effect of existing structural flaws in film laminates, particularly those extending or potentially extending in a lateral or long axial direction; such flaws can expand prematurely and vent off heat and pressure generated during the first third (time-wise) of a firing sequence (ref. FIG. 3), with resulting reduction in the initial formation of microflaws;

(2) to adjust the hoop or circumferential strength of the outer layer such that the dimensional clearance or tolerance between the outer expansion-resistant surface of the casing and the interior wall of a gun breach does not reach zero (0) before general failure of the outer element of the casing has occurred. This fine tuning is commonly achieved by (A) applying either monoaxial or biaxially oriented film such as heat shrinkable polyethylene terephthalate polyimide as film laminate(s) forming the outer and/or inner casing layers, with the axis of highest tensile strength generally directed in a circumferential or spiral direction at about 70°–90° relative to the long axis of the propellant casing when forming the casing wall. In this manner, and by varying film thickness the adhesive layer(s) and winding direction, it is possible to optimize the amount of expansion resistance built into the casing; and (B) by applying to the inner element of the casing an adhesive coating of one or more layers, such as an epoxy or similar adhesive composition, capable of setting up to form a relatively brittle coating i.e. a coating having little (less than 2%) plastic flow between the inner element and the outer layer of the casing. For purposes of the present invention, and assuming the use of a primer layer, such coating(s) can also include acrylate-type adhesives, casing glues (vinyl acetate emulsions), and the like in a suitable binding agent (ref. U.S. Pat. No. 3,932,329), as well as a silicon dioxide slurry.

The amount of adhesive, and its energy content can also vary; energy content being preferably maximized, in a manner having the smallest effect on structural integrity, shock, and flame-sensitivity, by incorporating filler components directly into the adhesive before application and set up, such as one or more of nitroguanidine, RDX, nitroesters, HMX, and PETN propellant, preferably in a fine crystalline form. For present purposes, an optional premixture, in a booster amount can comprise up to about 40% by weight of adhesive;

(3) As an alternative or supplement to the above fabrication and film orientation techniques, various art-known molding processes such as blow molding, injection molding, stretch blow molding can be used to form relatively thin inner polymeric elements which can be used in combination with the adhesive coating. As above noted, either or both of the outer layer and inner element can optionally be over wound with a high tensile strength fiber winding (preferably 1–3 mil thick), to obtain the desired modulus and still provide physical room for additional propellant packing; and (4) to utilize as a high tensile strength fiber or filament such as carbon fiber, Kevlar$^R$ aramid fiber, Spectra$^R$ fiber or combinations thereof, as well as admixtures with fiberglass type fiber or filament, embedded in or combined with adhesive.

BRIEF DESCRIPTION OF THE FIGURES

The present invention is further demonstrated in accompanying FIGS. 1–3, 4 (A–E) and 5–6, in which.

DETAILED DESCRIPTION OF THE FIGURES

Figure 1:
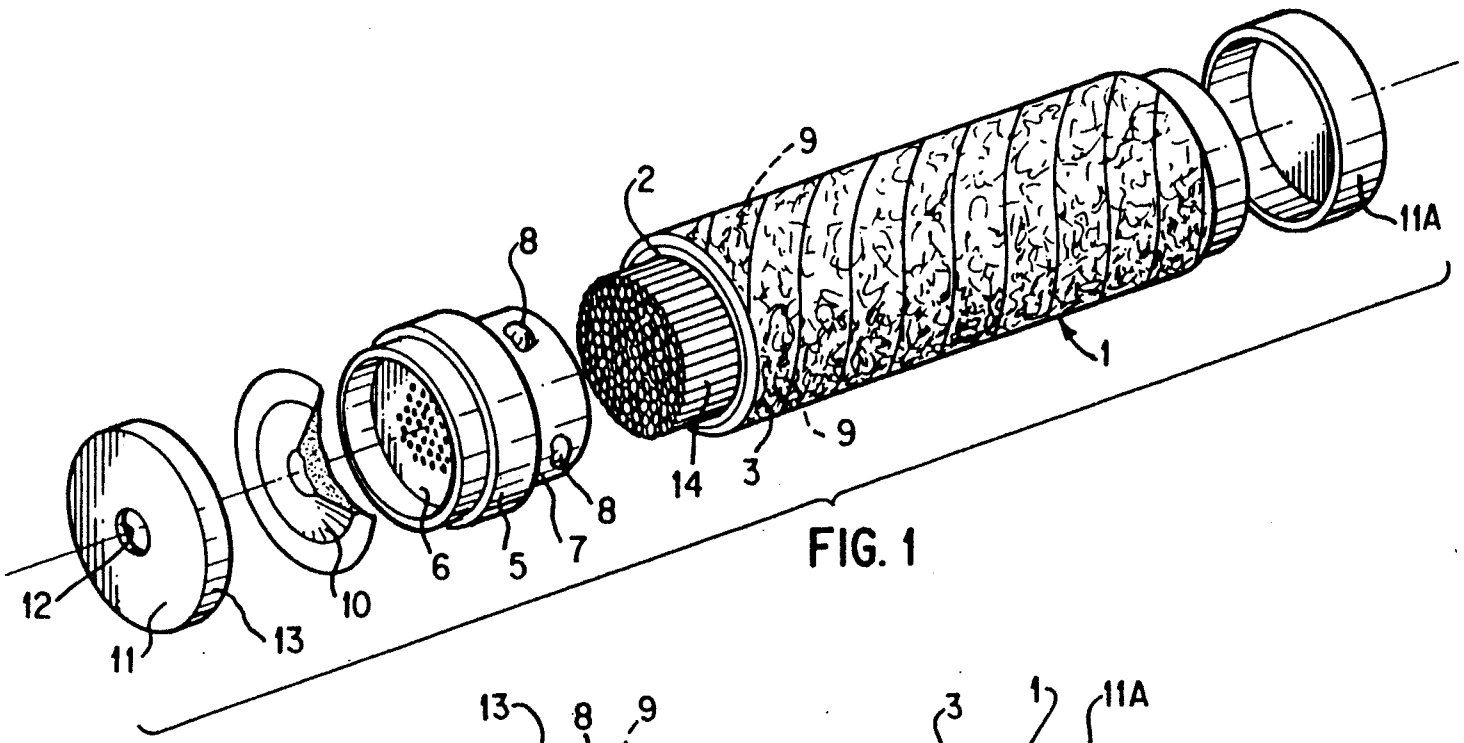
FIG. 1 is an exploded pictorial view of a single unfired propellant casing with the major components demonstrated. This casing, lacking the usual metal base plate bayonet igniter tube and warhead components, also represents part of an artillery or tank round in which propellant in various conventional forms may be utilized.

Looking further to FIG. 1, there is a propellant chargecontaining cylindrical-shaped casing (1) comprising, in combination, an inner polymeric element (2), an adhesive layer applied thereon (not shown), and an outside layer (3) of high expansion-resistant material shown as a preferred circumferential fiber/laminate winding (not individually shown). Locking ports (9), are evenly distributed around the front end of casing (1). Adapted for fitting endwise into and onto the front end of casing (1) and around stick propellant charge (14) is end piece (5), comprising a perforated front flange element (6) and a soft rear flange element (7) equipped with projecting locking tits (8), said rear flange element being adapted by a slightly smaller diameter for telescoping into casing (1) around propellant (14) and locking onto the casing (1) by fitting locking tits (8) internally into locking ports (9).

An igniter base pad (10) (shown in fragment) consisting of a thin open weave bag of coarse black powder, is fitted into front flange element (6), and covered by end cap (11) equipped with firing port (12) and having an outside flange (13) capable of tightly fitting around front flange element (6), whereby an initiating spark introduced through port (12) will set off the igniter base pad (10) and main propellant charge (14) through perforations in front flange element (6).

Figure 2A:
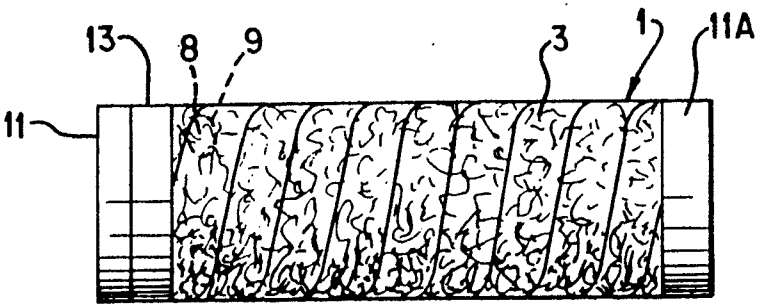
FIG. 2A is a side elevational view of the assembled casing of FIG. 1 alone and in the form of multiples thereof combined endwise as two (FIG. 2B) or three (FIG. 2C) casing units to provide optimal energy for firing shells over varying range distances.
Figure 2B:
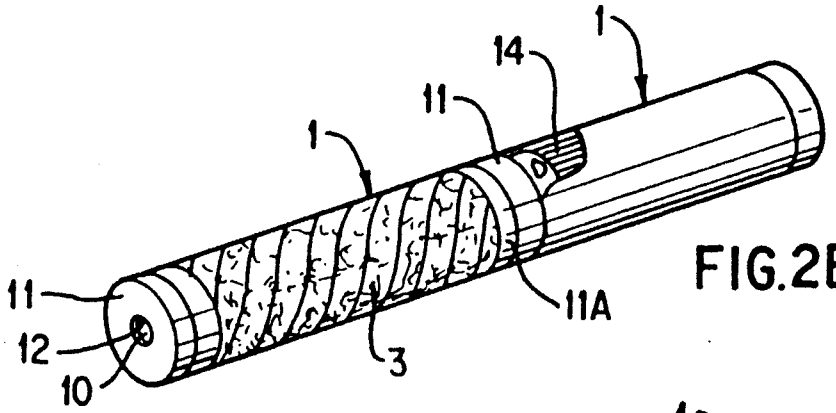
Figure 2C:
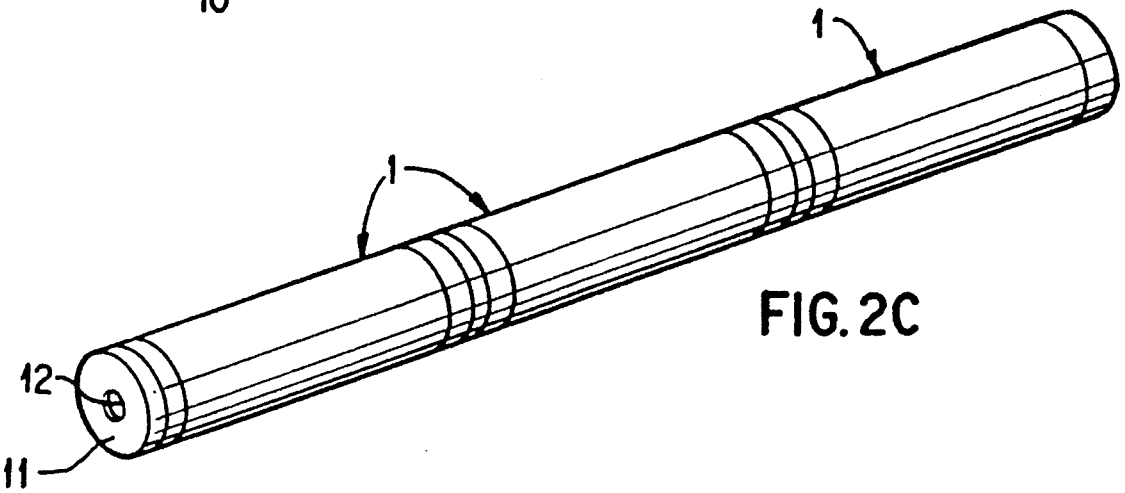

FIGS. 2A–C represent possible multiple combinations of propellant casings of the type shown in FIG. 1, in which one or more end caps (not shown as combined) are removed and the casings telescoped at the respective end (14) and front (6) flanges.

Figure 3:
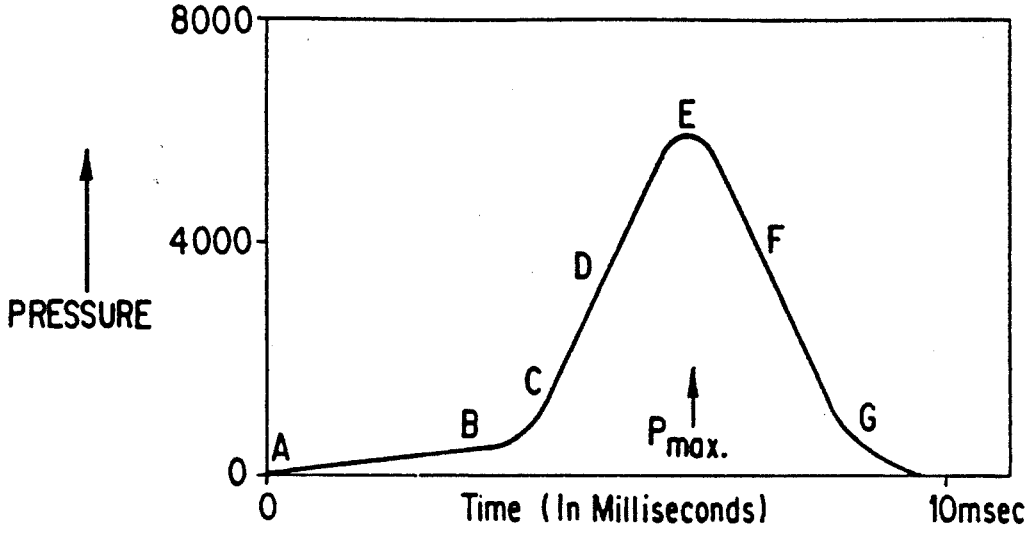
FIG. 3 is an idealized graph representing the buildup of internal casing pressure (psi) against time (milliseconds) during a firing sequence, with overlaid points (A–G) provided to generally correlate certain internal events within a casing, to such firing sequence.

FIG. 3 represents an idealized graph correlating Internal Casing Pressure (shown up to about 8000 psi.) vs. Time (0–10 milliseconds) for a propellant casing of the type shown in FIG. 1. in a normal propellant firing sequence. The respective points, identified as A–G on this graph, as noted above, represent approximate locations in a firing sequence for anticipating certain internal structural changes required to effect fragmentation and combustion of a casing fabricated in accordance with the present invention.

Figure 4A:
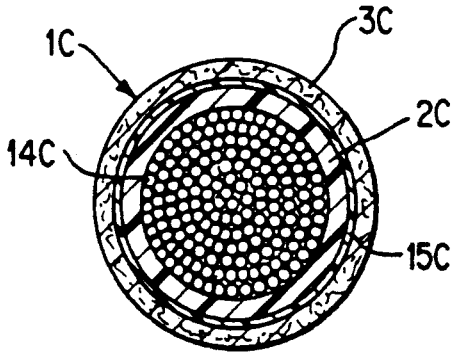
FIGS. 4A–E represent, in sequence, schematic cross-sections at a constant midpoint of a propellant casing such as FIG. 1, each view generally corresponding to the time/pressure relationship along the corresponding line A–E in FIG. 3, the respective components not being shown in exact proportion or dimensions.

By way of example, points "A"–"C" represent initial firing and the start of an internal pressure buildup phase in which the outer or expansion-resistant layer (see FIGS. 4A–C) remains intact but the inner element (2C) and the brittle adhesive layer (15C)are expanded against the inside face of the outer layer and many microflaws are randomly created in the inside and adhesive layers (not shown). At point "D" of the graph, the outer expansion-resistant layer begins to rapidly fail and, over a relatively small part of the casing life (less than a millisecond), the casing completely disintegrates coincidental with combustion of the resulting microparticles within the time period represented by the line E–G.

FIG. 4A–4E represent a schematic cross-section taken at an common midpoint in a casing as shown in FIG. 1, and corresponding approximately time-wise and event-wise, to points A–E in FIG. 3. As shown, stick propellant (14C)-filled casing (1C), comprising an inner element (2C), an intermediate brittle adhesive layer (15C), and an expansion-resistant outer element shown as a fiber winding (3C) are represented in static unfired condition. As above noted, the components are not shown in actual geometric proportion.

Figure 4B:
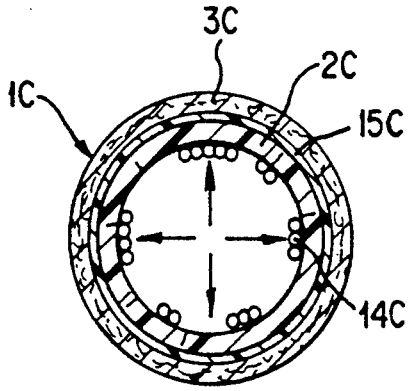
Figure 4C:
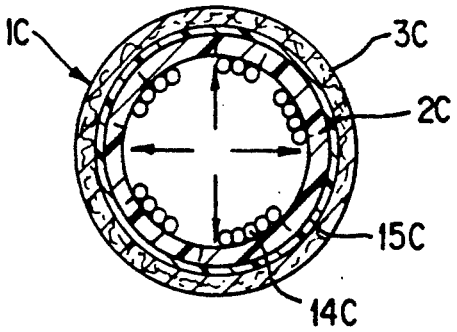
Figure 4D:
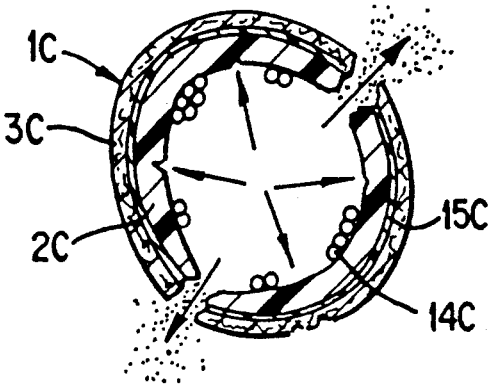
Figure 4E:
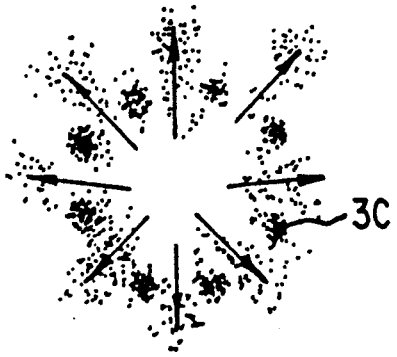

In FIG. 4B, the firing sequence has begun (point B of FIG. 3), hoop stress is building within the casing and starting to force the adhesive layer (15C) and inner element (2C) against outer layer (3C) while microflaws (not shown) are starting to randomly form within the adhesive layer;

In FIG. 4C, significant internal shear forces are developing within the casing layer (3C) with the continued creation and propagation of microflaws (not shown) randomly within the casing layers;

In FIG. 4D (corresponding approximately to point "D" in FIG. 3), the outer layer (3C) has visible flaws and has failed at several points along a circumferential, as opposed to the longitudinal direction normally associated with elastic failure of a cylinder. The casing failure preferably occurs at or along the graph line identified as D–E in FIG. 3. Internal casing pressure at the time of casing failure can usefully vary from about 1000 psi to about 6000 psi, depending upon the choice and amount of propellant and the desired strength of the outer casing element;

FIG. 4E represents a complete failure of the casing layers, which are converted into micro particles, which are rapidly combusted under the pressure/time conditions represented by line E–G of FIG. 3.

The total time lapse between FIGS. A–E in the FIG. 3 graph normally would require no more than about 5–7 milliseconds.

Figure 5:
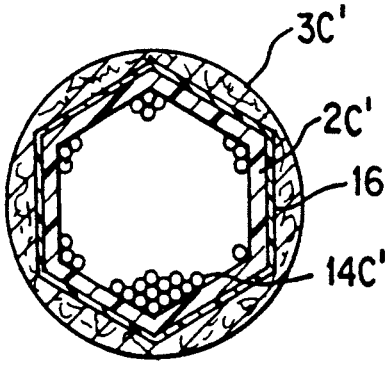
FIG. 5 is a schematic cross-section of a modified casing generally comparable to the situation represented in FIG. 4B, in which the inner element (2C') is in the form of a multifaceted or polyfaced configuration (here six-sided) to facilitate an even expansion and well distributed formation of microflaws or flaws (not shown) in the casing wall during a firing sequence.

FIG. 5 demonstrates, in schematic cross-section, an unfired modification of inner element (2C') in the form of a molded multi-sided expandable inner component having adhesive layer (16') as a filler layer between the inner (2C') and outer (3C') elements of the casing. Also shown is stick propellant 14C'.

Figure 6:
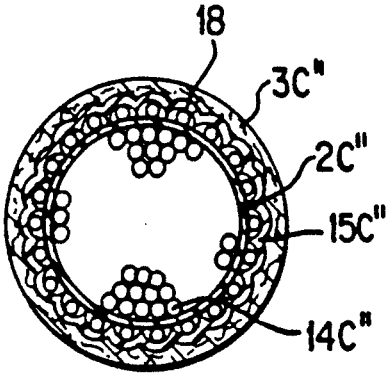
FIG. 6 is a schematic cross-section of a modified casing roughly corresponding to FIG. 4A, in which the inner element (2C'') is in the form of a corrugated layer into which is fitted additional propellant material (shown here as sticks of propellant).

FIG. 6 demonstrates, in schematic cross-section, a further casing modification in which the inner layer 2C'' is in the form of a corrugated layer in which the peripheral opened spaces contain additional propellant (18C'') as desired in addition to propellant 14'', the remaining numbered components corresponding essentially to those identified by the same arabic numbers in the preceding drawings.

A further useful modification of the inner propellant element, as described above, can include the addition of an added intermediate barrier layer such as a thin metal layer, or an $SiO_2$ coating on polyethylene terephthalate film.

The foregoing description and accompanying drawings are intended being illustrative of preferred embodiments of the invention, and not as limiting the invention. It is to be understood that modifications and changes may be made in the embodiments disclosed herein without departing from the spirit and scope of the invention as expressed in the appended claims.

We claim:

1. A method for increasing fragmentation and combustion rate of a propellant charged polymer-containing gun propellant casing used in a firing sequence, comprising manufacturing a casing wall comprising a propellant-holding inner element, an intermediate adhesive layer, and an outer expansion-resistant cylindrical-shaped casing layer externally concentrically arranged with respect to said inner element, said outer layer and said inner element comprising consumable and fragmentable polymer components selected from the group consisting of films, film laminates, and fiber windings having a hoop strength relative to corresponding longitudinal casing wall strength in a range of about 100–1000 to 1; wherein said outer layer and said inner element are characterized individually as having circumferential moduli of said outer layer-to-said-inner element within a ratio of about (10–50)-to (1–8); wherein propellant ignited within said inner element generates an effective amount of pressure, initially effecting expansion of said inner element and adhesive layer against said outer expansion-resistant layer, creating a plurality of randomly positioned microflaws having rapid propagation velocity within said casing, thereby obtaining a high degree of microfragmentation and combustion of casing components.

2. The method of claim 1 wherein said adhesive layer is brittle.

3. The method of claim 2 wherein said adhesive layer comprises a low energy polymeric material.

4. The method of claim 3 wherein said adhesive layer comprises at least one coat of a brittle adhesive selected from the group consisting of epoxy-and acrylate-type adhesives.

5. The method of claim 2 wherein said adhesive contains a booster amount of a filler component of at least one member selected from the group consisting of NQ, RDX, HMX, PETN, and inorganic nitrate salt.

6. The method of claim 1 wherein said inner element comprises a laminate of overlapping film layers axially oriented and wound in a generally circumferential direction relative to said casing.

7. The method of claim 1 wherein said inner element comprises a polymer molded by a method selected from the group consisting of blow molding, injection molding and stretch molding.

8. The method of claim 1 wherein said inner element comprises a laminate of heat shrinkable polymer film.

9. The method of claim 1 wherein the cylindrical shaped outer casing layer is formed by winding high modulus fiber circumferentially within about 70°–90° relative to the long axis of said propellant casing.

10. A consumable gun propellant casing comprising, in combination, (i) an open ended inner element of at least one expandable polymeric layer holding propellant material;

(ii) an open ended expansion-resistant cylindrical shaped outer layer externally concentrically arranged with respect to said inner element, said outer layer having a circumferential modulus higher than the corresponding circumferential modulus of said inner element and wherein said outer layer and said inner element are characterized individually as having circumferential moduli of said outer layer-to-said-inner element within a ratio of about (10–50)-to-(1–8); and (iii) a brittle adhesive layer positioned between said inner element and said expansion resistant outer layer, wherein said inner element, said outer layer and said adhesive layer comprises consumable and fragmentable materials.

11. The consumable gun propellant casing of claim 10 further comprising at least one consumable end cap secured to the open ends of said propellant casing said at least one end cap having a firing initiator port functionally associated with an igniter assembly means for effecting the firing of propellant material held within said casing; whereby propellant ignited by said igniter assembly means through said igniter port initially generates an effective amount of pressure with expansion of said inner element and adhesive layer against said expansion-resistant outer layer, creating a plurality of randomly positioned microflaws having rapid propagation velocities within said expansion-resistant outer layer before failure of said expansion-resistant outer layer, to effect microfragmentation and consumption of the consumable gun propellant casing.

12. The propellant casing of claim 10 wherein said adhesive layer comprises a brittle low energy polymeric material.

13. The propellant casing of claim 10 wherein said adhesive layer comprises a brittle adhesive selected from the group consisting of epoxy-type adhesives and acrylate-type adhesives.

14. The propellant casing of claim 10 wherein said adhesive layer comprises an energetic filler component selected from the group consisting of NQ, RDX, HMX, PETN, and inorganic nitrate salt.

15. The propellant casing of claim 10 wherein said inner element comprises a laminate of overlapping film layers axially oriented and wound in a generally circumferential direction relative to said cylindrical shaped casing.

16. The propellant casing of claim 10 wherein said inner element comprises a material selected from the group consisting of blow molded polymers, injection molded polymers and laminates of heat shrinkable polymeric film.

17. The propellant casing of claim 10 wherein the externally arranged cylindrical shaped outer casing layer comprises a winding of high modulus fiber arranged circumferentially within about 70°-90° relative to the long axis of said propellant casing.

18. The propellant casing of claim 13 wherein said outer layer comprises a high modulus carbon fiber winding.

* * * * *